US007353638B2

(12) United States Patent
Salemi

(10) Patent No.: US 7,353,638 B2
(45) Date of Patent: Apr. 8, 2008

(54) SOUND RESISTANT ENCLOSURE

(75) Inventor: Michael Salemi, Worburn, MA (US)

(73) Assignee: Salemi, Inc, Woburn, MA (US)

( * ) Notice: Subject to any disclaimer, the term of this patent is extended or adjusted under 35 U.S.C. 154(b) by 199 days.

(21) Appl. No.: 11/352,149

(22) Filed: Feb. 10, 2006

(65) Prior Publication Data

US 2007/0186490 A1 Aug. 16, 2007

(51) Int. Cl.

| | |
|---|---|
| ***E04H 1/14*** | (2006.01) |
| ***E04B 1/82*** | (2006.01) |
| ***H04M 1/00*** | (2006.01) |
| ***E06B 3/34*** | (2006.01) |

(52) U.S. Cl. ..... 52/27.5; 52/144; 52/145; 379/453; 49/40

(58) Field of Classification Search ..... 52/27.5, 52/36.1, 144, 145; D25/16; 379/441, 453, 379/454; 472/130; 434/306, 432; 49/40, 49/41; 181/198

See application file for complete search history.

(56) References Cited

U.S. PATENT DOCUMENTS

| | | | | | |
|---|---|---|---|---|---|
| 756,091 | A | * | 3/1904 | Atlick | 52/71 |
| 756,555 | A | * | 4/1904 | Atlick | 52/65 |
| 931,502 | A | * | 8/1909 | Sherron | 49/40 |
| 1,221,910 | A | * | 4/1917 | Schureman | 52/65 |
| 1,780,251 | A | * | 11/1930 | Teplow | 312/239 |
| 2,028,628 | A | * | 1/1936 | Sherron | 49/40 |
| 2,248,810 | A | * | 7/1941 | Corso | 52/28 |
| 2,270,939 | A | * | 1/1942 | Eckardt | 181/290 |
| 2,821,038 | A | | 1/1958 | Gee | |
| 2,982,593 | A | | 5/1961 | Chambers | |
| 3,063,496 | A | | 11/1962 | Kessler | |
| 3,111,720 | A | | 11/1963 | Sherron | |
| D213,096 | S | * | 1/1969 | Antonio et al. | D25/16 |
| 3,959,607 | A | | 5/1976 | Vargo | |
| 4,174,594 | A | * | 11/1979 | Panzini | 52/65 |
| 4,192,099 | A | | 3/1980 | Simko | |
| 4,432,170 | A | | 2/1984 | Hewell | |
| 4,754,582 | A | | 7/1988 | Cameron | |
| 4,961,294 | A | | 10/1990 | Cameron | |
| 5,031,366 | A | | 7/1991 | Cameron | |
| 5,182,883 | A | | 2/1993 | Amberson et al. | |
| D354,407 | S | * | 1/1995 | Baloga et al. | D6/421 |
| 5,452,547 | A | * | 9/1995 | Baloga et al. | 52/32 |
| 5,653,063 | A | * | 8/1997 | Barnett et al. | 52/29 |
| D399,505 | S | * | 10/1998 | Kranz | D14/146 |
| 6,669,553 | B2 | | 12/2003 | Noise | |
| 2001/0018325 | A1 | | 8/2001 | Adams | |
| 2003/0182864 | A1 | * | 10/2003 | Yokotachi | 49/40 |

* cited by examiner

*Primary Examiner*—Robert Canfield
*Assistant Examiner*—Jessie Fonseca
(74) *Attorney, Agent, or Firm*—Law Offices of Michael Leccese, P.C.

(57) ABSTRACT

A sound resistant enclosure apparatus adapted for a person have access to an environment that reduces sound from ambient noise. More particularly, the invention relates to a manner in which to use common fabrication materials and method to construct a sound resistant enclosure or booth for use to make or receive cellular telephone calls in relative quiet. The apparatus include among its essential elements, a cylindrical outer wall, a cylindrical inner wall, a door, a top or roof, a floor and sound resistant material mostly deposited between the inner and outer walls. Sound resistant material can also be found in the door, roof and walls. The sound resistant enclosure blocking much of the ambient environmental noise such that the occupant of the enclosure can make or receive a cellular phone call more effectively and efficiently without having distracting unwanted extraneous environmental noise interrupting their conversation.

14 Claims, 4 Drawing Sheets

SOUND RESISTANT ENCLOSURE

FIELD

The invention relates generally to a cylindrical sound resistant enclosure, the sound resistant enclosure is adapted such that a person can open the door to the enclosure, enter the enclosure, then close the door of the enclosure behind them so that the person is inside the enclosure thereby creating a sound resistant environment for the person. Once the person is inside the enclosure with the door closed the enclosure blocks substantially any exterior noise creating a relatively quiet environment blocking many audible noises. The enclosure creates a quiet environment for the occupant allowing the occupant to perform such tasks as converse on a cell phone without distraction from exterior noise. In addition the enclosure also creates an environment that allows for noise not to exit the sound resistant enclosure, whereas the occupant can converse on a cell phone inside the enclosure and someone outside the enclosure cannot hear the conversation. The enclosure, among other items includes a light and ventilation for comfort of the occupant, the enclosure also having a door and a ramp leading into the enclosure, such that the door and ramp accommodates a physically challenged individual so the physically impaired can use the booth, which includes a person in a wheelchair.

BACKGROUND

In the past, telephone booths or telephone booth enclosures where found in many locations around the world, many of these booths accessible to the public, the telephone booth generally contained a phone within and maybe a phone book. Many phone booths are designed as an enclosure for a person to enter and others are designed as an open booth that merely protect the phone itself not allowing a person to enter. The present invention is directed toward a booth that a person can enter and close himself or herself in the booth, separating themselves from the ambient environment, separate themselves from the ambient sound environment. Typically in the past when a person wished to make a phone call they entered a telephone booth closed the door behind them place money in the phone (or used other forms of payment to make a call such as credit card or collect call) dialed the phone and made a call. The past phone booths offered a shelter from the weather as well as a place to make a telephone call. Many prior art past booths were constructed of glass or plastic sheet, i.e. the booth having three flat walls a flat door and a floor and ceiling, booths are generally square elongated glass or glass like enclosures. The booths may have blocked some sound but are not constructed specifically to block sound. Booths where frequent in number and could be found in many location such as along busy streets, inside hotels, bars department stores, arenas and other location frequented by the public or even private use. Telephone booths not only gave an individual the access to a telephone but also gave the person a closed private space to make the call. Prior art booths do not contain a multi layered sound resistant material therein that blocks and deadens sounds but merely provides four walls for shelter. Some telephone booths where not enclosed but merely a three sided enclosure that did not provide as much privacy as a closed booth. Many examples of these booths can be seen in the prior art, Prior art U.S. Pat. No. 3,063,496 discloses an invention for an outdoor telephone booth, more particularly a lightweight, rigidly assembled square shaped booth having walls or translucent plastic sheet material and having a door arrangement. Other prior art, U.S. Pat. No. 4,432,170 shows an invention for an outdoor telephone booth or type comprising a metal framework with transparent side panels and a light source in the ceiling of the booth for illuminating the booths interior. This booth comprises among other things two vertically elongated translucent side panels extending from the top to the bottom.

Most recently however telephone booths are quickly becoming a thing of the past, with the advent of mobile phones or wireless communications the need for telephone booths is quickly becoming obsolete. No longer does someone have to search for a phone booth that contains a phone to make a call when many people have portable hand held cellular phones and many more are procuring them. Today normally many people do not use a telephone that is fixed within a phone booth to make a call, they use a hand held portable wireless phone sometimes referred to as cellular phones which provides the user with virtually unlimited mobility to make a telephone call where ever the person is located. The person no longer has to search out a telephone booth, enter the telephone booth and make such a call. With portable phones the person merely picks up the hand held phone and places a call. However with the telephone booth becoming a thing of the past also becoming a thing of the past has been a place to go to make that call. Frequently, a person wishes to make a call in an atmosphere that is quiet so the caller can hear as well as speak to be heard. Having a hand held mobile phone sometimes this quiet comfortable place can be difficult to locate. With the advent of the hand held phone many environments exist that would be difficult to make a call so that the caller and person receiving the call can hear and converse in a normal manner. Conceivably many environments and situations exist in which making a cellular phone call would be difficult, the ambient noise surrounding the person making or receiving the call may be such that the person cannot hear or be heard, or in the alternative a quiet environment where a call can be made but someone nearby could easily over hear your call. One Good example of this type of environment would be a person located at a sporting event generally at a sports stadium, a location with many people in a relatively confined space. The person would make a call, place a call on their portable mobile phone, the noise, the crowd, and generally all the noise that comes with such a location would make it difficult if not impossible to hear anyone on the line or for the person to speak into the phone have the other person hear them. In the past the caller could have gone to an enclosed phone booth though not completely sound resistant provided some quiet to a caller could make a call. However as these telephone booths become less common the caller may find it difficult to find a quiet place to make a call. In yet an other example of a place difficult if not impossible to make a phone call and expecting to hear the call or have the person on the other end hear you would be just about any crowded public space. Such as walking up a busy street, or eating in a restaurant, or a bus station, or any locations having a gathering of persons that can be very noisy preventing someone from making a call because of the noise. In some cases at ticketed events such as sporting arena it may not be desirable to leave the arena to get to a quiet place to make a call, many arenas would not allow the person to re-enter. The inventor has seen and solved the need for a location in such environment to quickly and quietly make a phone call without having to go a distance to reach a quiet place to make a call.

Today, it is common that there are less and less phone booths available and more cell phones per person than ever before. People use mobile phones in every place they can carry one, more often people wish to make phone calls on there mobile phone in environments that may have noise, such as a sport stadium, night club, hotel lobby, or just about any public place that typically has lots of activity and lots of noise. Many times the caller wishes to find a location to make a call that would block out some of the exterior noise so the caller can successfully make the call without having to contend with extraneous noise. The inventor has seen the need for a quiet place to make such a portable phone call and has developed this solution. In addition to the present invention blocking outside noise so a caller can make a phone call the caller may also want a private place to make a call where no one can hear what the caller is saying during his conversion. It is common that people making calls in a public place can be over heard by other people, this invention of the sound resistant booth solves this problem.

In the past other phone booths or other prior arts did not provide the sound resistance that the inventors booth does, the inventors design provides for a cylindrical sound resistant booth for someone to enter and keep noise out or to keep others from hearing the call. In addition the inventor has made the booth accessible to handicapped persons.

SUMMARY

This invention provides an apparatus for a sound resistant enclosure wherein a person can enter the enclosure and get away from surrounding noise. More particularly embodiment of this invention relates to a manner is which to use common building materials and methods in the fabrication of a sound resistant enclosure more effectively and efficiently than in the past. Using embodiments and implementations of this invention will allow the user to construct and use a sound resistant enclosure. In most cases the person enters the sound resistant enclosure to participate in a phone conversation without having someone else nearby hear the conversation or the person can participate in a phone conversation protected from ambient surrounding noise. The present invention is directed toward construction and use of a sound resistant enclosure. Generally the construction of this enclosure is a cylindrical booth having sound resistant material within, a ramp, a door, an interior light and ventilation. A person wishing to go to a space that is quieter that the ambient surroundings opens the door to the booth enters the booth closes the door behind and now is enclosed in a quiet environment, once within the quiet environment the person perhaps can place or receive a cell phone call in relative peace and quiet without having a large amount of ambient noise to contend with or worry about someone nearby hearing or listening in on their conversation. One additional advantage of the booth enclosure is also a quiet private place to make such a call where no one else outside the enclosure can hear you provide the user with assurance that the conversation will not be overheard as easily as if being outside the enclosure.

The enclosure is substantially a cylindrical construction having a pocket door that slides between an outer wall structure and an inner wall structure, the enclosure also having a top and bottom. The invention may also include an inner light, ventilation and a ramp for easy access. Some illustrations of this invention are handicapped and physically impaired accessible. A sound resistant material is located between the inner and outer wall structures of the invention to reduce noise from getting into and out of the enclosure. Sound resistant material can also be located at the top an bottom of the enclosure.

The inventor has found that the most effective sound proofing material can be selected from common building materials such as fiberglass textile, continuous glass fibers, glass oxide chemicals, cotton fiber or any similar materials. The inner and outer walls can typically be fabricated using metal, plastic or even wood, any material that is rigid so the retain the shape. The door in general can be manufactured from at least one single piece of clear polycarbonate material or acrylic, the door can also be fabricated from the same or similar materials as the inner and outer walls then incorporating a window manufactured from a clear polycarbonate material or clear acrylic material, the door or door window being transparent so a person can see through it and to allow light into the enclosure. The cylindrical and disc shaped perforated sound shield is in general fabricated from perforated metal such as a mild steel or corrosion resistant steel commonly available, this perforations can be any shape that is through the shield.

It is an object of this invention to provide an apparatus and method of providing a sound resistant enclosure for perhaps making a cellular phone call out of ambient surroundings. More particularly the invention uses present technology of today's manufacturing methods and materials to accomplish the result of creating a sound resistant enclosure for a person to enter and be temporally isolated from ambient conditions.

One illustration of this invention embodies a handicapped accessible embodiment. Typically having a larger area to accommodate a wheel chair as well as a ramp to enter the booth.

The principles preferred embodiments and modes of operation of the present invention have been described in the forgoing specification. The invention which is intended to be protected herein, however, is not to be construed as limited to the particular embodiments disclosed, since these embodiments are to be regarded as illustrative rather than restrictive. Variations and changes may be made by others without departing from the spirit of this invention. Accordingly, it is expressly intended that all such variation and changes which fall within the spirit and scope of the claims be embraced thereby.

BRIEF DESCRIPTION OF DRAWINGS

Other objects, features, and advantages will occur to those skilled in the art from the following description of an embodiment and the accompanying drawings, in which.

DETAILED DESCRIPTION

Figure 1:
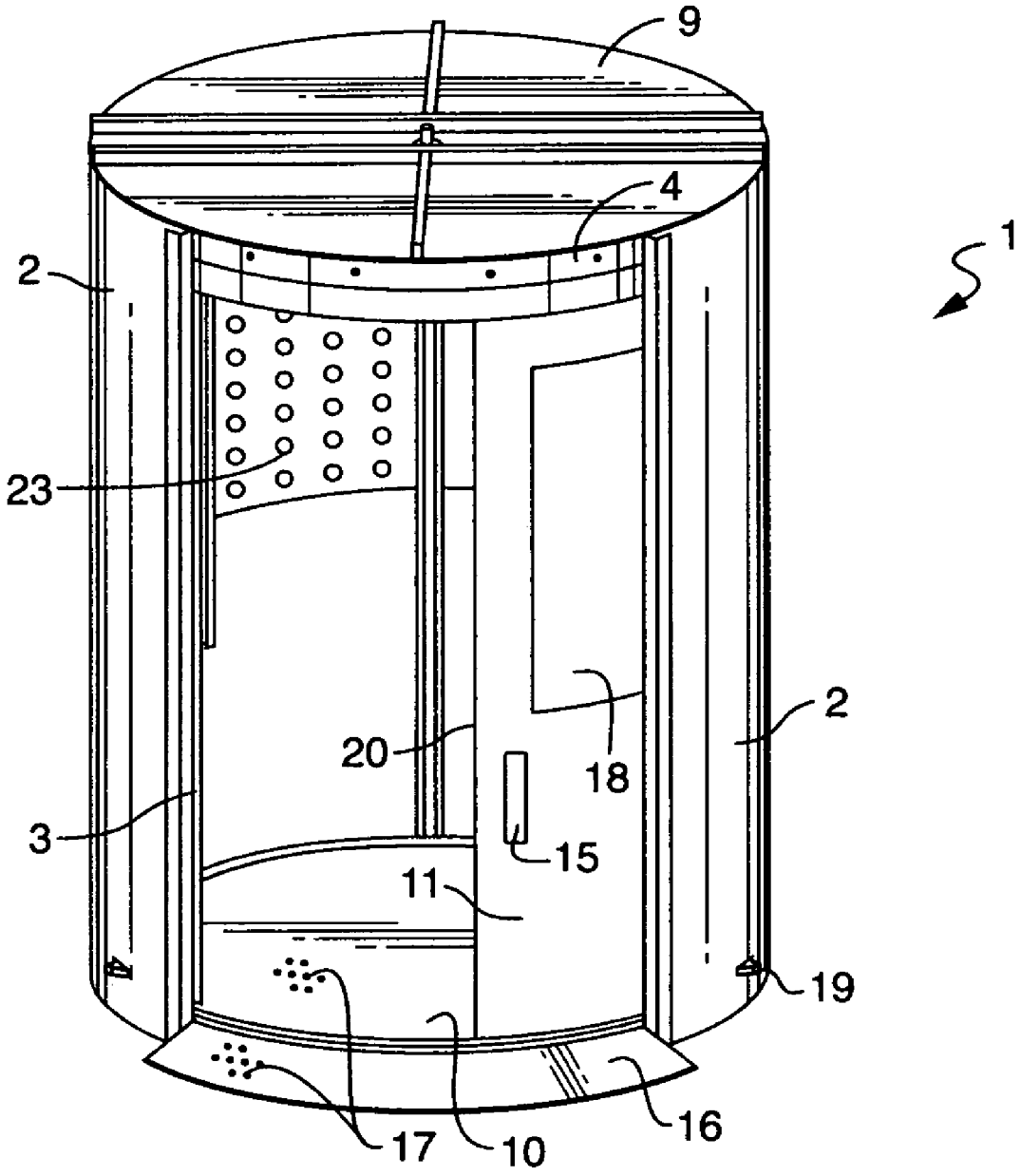
FIG. 1, shows a front view of the enclosure assembly
Figure 2:
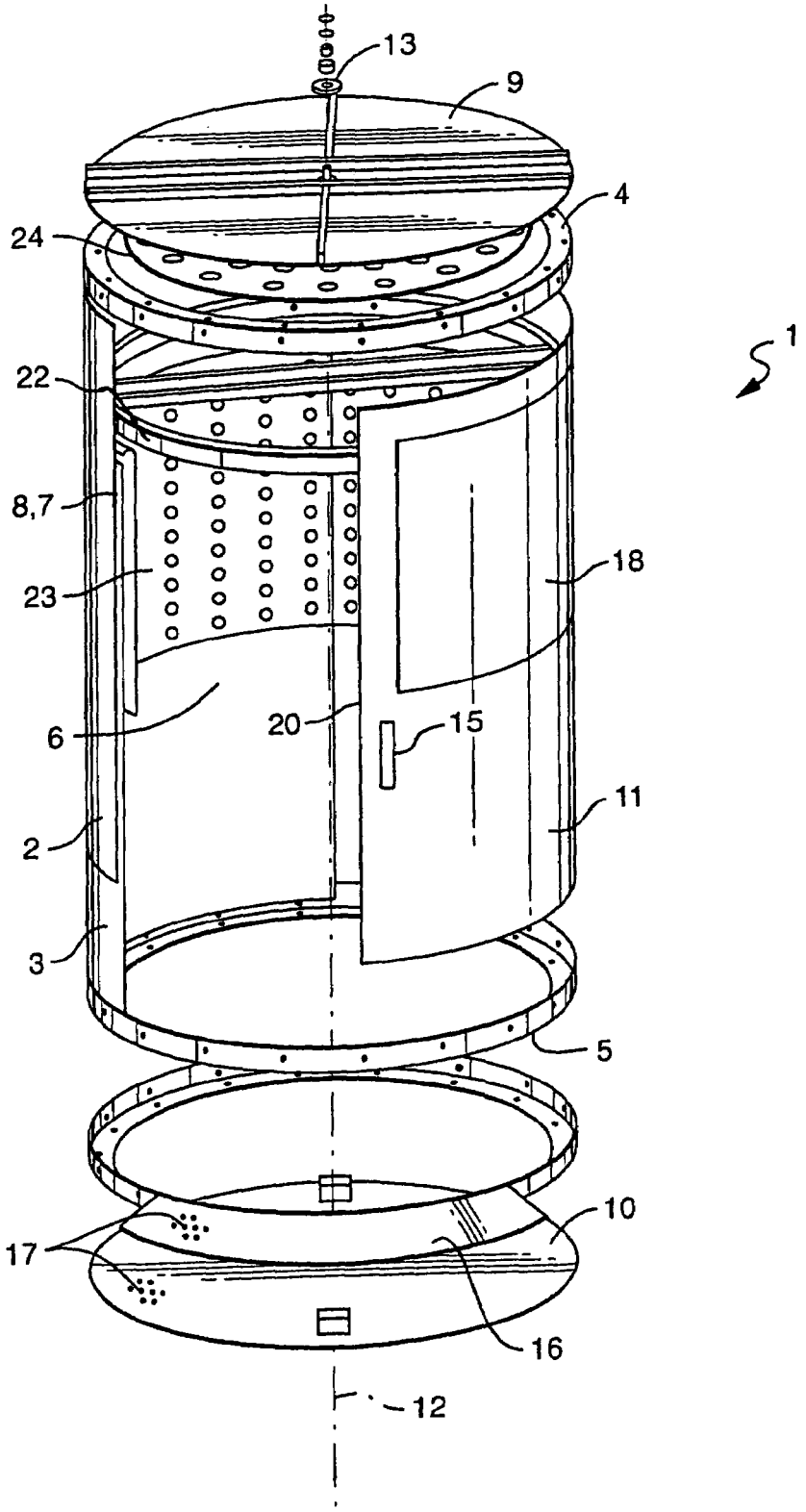
FIG. 2, shows an exploded view of the enclosure assembly
Figure 3:
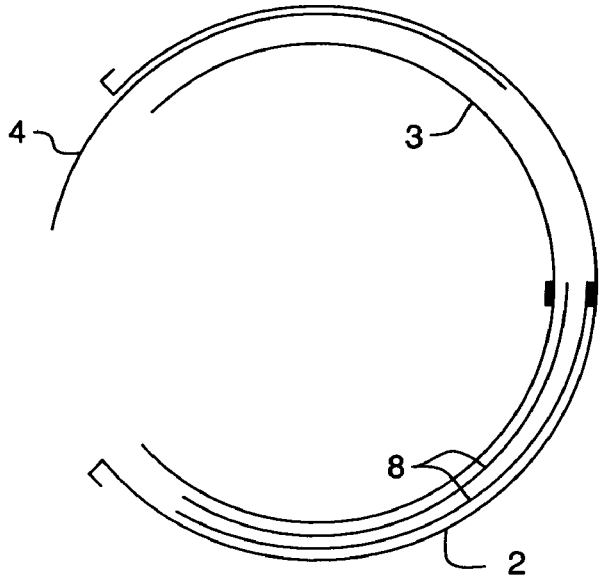
FIG. 3, shows a section view of the enclosure featuring the outer wall, inner wall, door and sound resistant material
Figure 4:
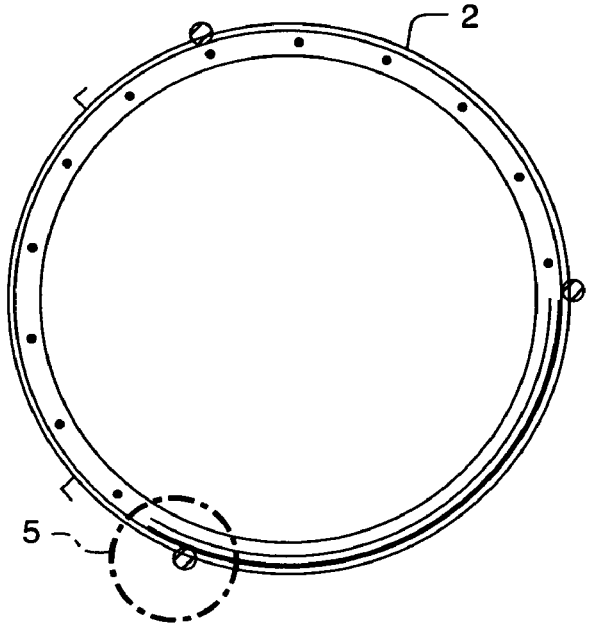
FIG. 4, shows a, shows a section view of the enclosure featuring the lower support ring the door and the door roller feature
Figure 5:
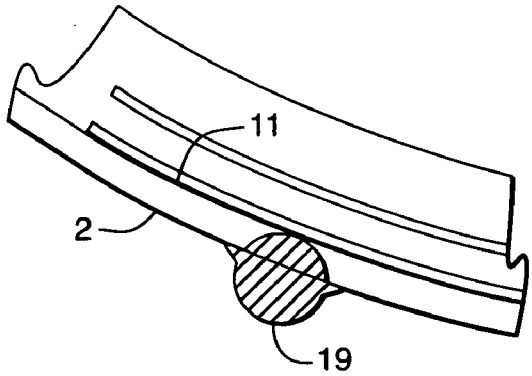
FIG. 5, shows a detailed view of the outer wall, door and roller feature
Figure 6:
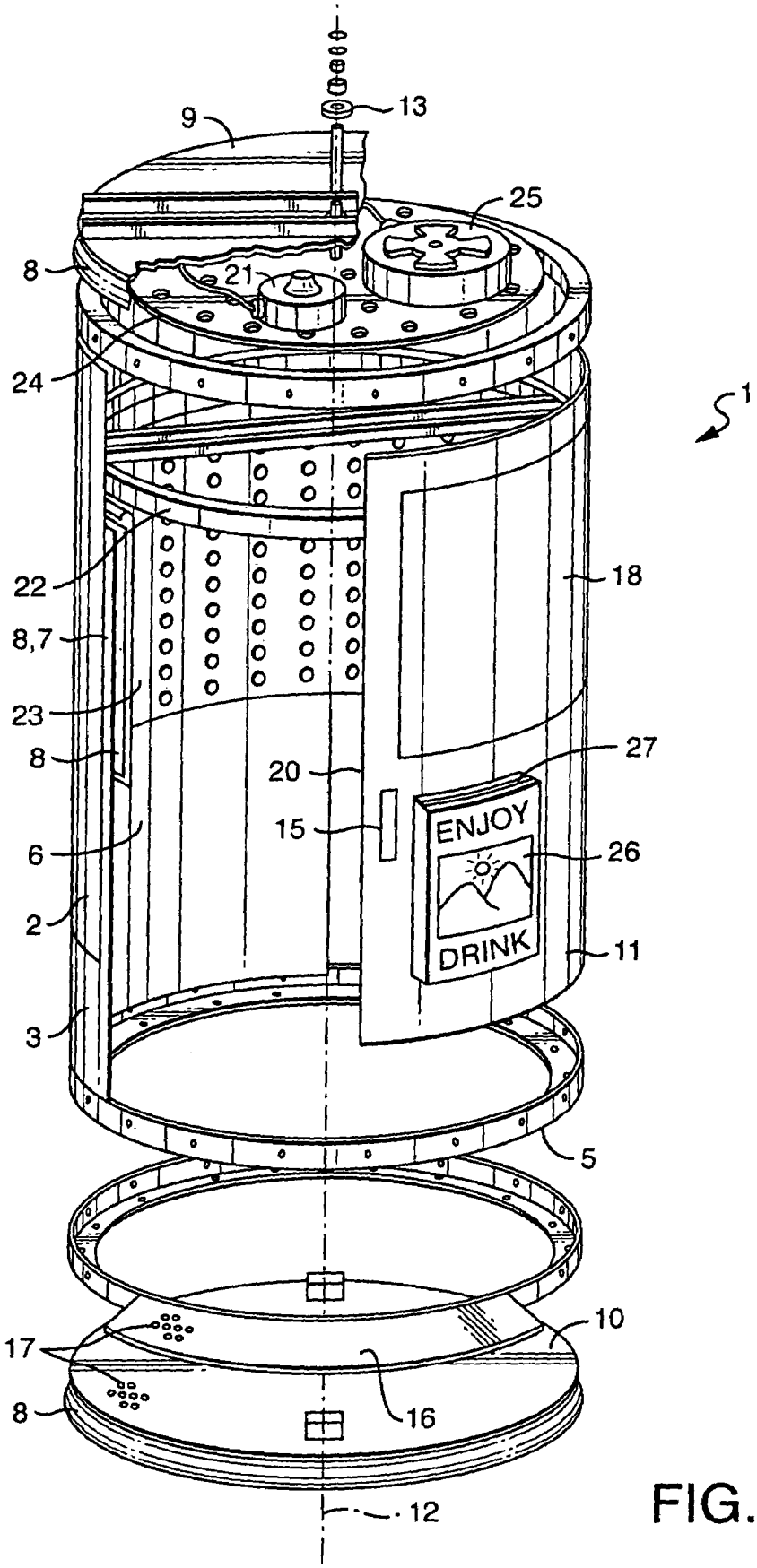
FIG. 6, shows an exploded view of the enclosure assembly.

A cylindrical sound resistant enclosure 1 used for blocking ambient noise comprising an outer wall 2, substantially cylindrical in shape, fixedly attached to at least a first top attachment support ring 4 and at least a bottom attachment support ring 5 making up the exterior of the invention. The outer cylindrical wall 2 having an opening 6 therein, the opening used for an entrance way into the enclosure. An inner wall 3 also substantially cylindrical fixedly attached to the first top attachment support ring 4 and fixedly attached to at least the bottom attachment support ring 5. The inner cylindrical wall 3 of the enclosure 1 being substantially coaxial to the outer wall of the enclosure that is also cylindrical. The inner cylindrical wall also having an opening 6 therein wherein the radial position of the inner cylindrical wall opening is substantially aligned with the outer cylindrical wall 2 opening 6 creating an entrance path into the enclosure. The inner cylindrical wall 3 is fabricated in the form as a smaller diameter than the outer cylindrical wall, the inner cylindrical wall substantially co-axial to the outer cylindrical wall wherein creating a space 7 between the outer and inner cylindrical wall. A top member 9 fixedly attached to the top attachment support ring. Deposited in the space between the inner and outer wall is a sound resistant material 8. In one illustration to better aid in suppressing audible environment a perforated substantially cylindrical sound shield 23 can be fixedly attached to the inner wall 3. The sound shield 23 having a smaller diameter that the inner wall 3, generally the sound shield 23 substantially co-axial to the inner cylindrical wall wherein creating a space between the sound shield 23 and inner cylindrical wall 3. Sound resistant material 8 occupying the space between the inner cylindrical wall 3 and the sound shield 23. Also included is a perforated substantially disc shaped sound shield 24 fixedly attached within the booth creating a space between the disc shaped sound shield 24 and the top member 9, sound resistant material 8 occupying the space between the disc shaped sound shield 24 and the top member 9. To complete the enclosure the top member 9 is fixedly attached to the top attachment support ring 4 acting as a roof. The enclosure also having a floor 10 fixedly attached to the bottom attachment support ring 5, the floor 10 capable of at lease supporting a persons weight.

To enter the enclosure the enclosure has a door member 11 being generally constructed of a section of a substantially cylindrical member co-axial to the inner 3 and outer walls 2. The door 11 pivots on the cylindrical axis 12 of the enclosure sliding the door between the outer 2 and inner wall 3 members allowing a person to enter the enclosure 1, the door 11 having a smaller diameter than the outer wall and a larger diameter than the inner wall. The door rotatably mounted on a bearing 13 mounted between the first 4 and second 22 top support rings allowing for the second support ring 22 to rotate, the door fixedly attached to the second top support ring 22. The door adapted to rotate co-axial to the inner wall 3 and outer cylindrical wall 2 members such that the door slides between them, pivoting about its radial centerline 12. The door 11 is adapted to obstruct the opening 6 in the inner 3 and outer 2 cylindrical walls when closed, the door is adapted to rotate between the inner 3 and outer 2 cylindrical wall such that to expose the openings 6 in the inner and outer cylindrical walls when open. A door stop 14 stops wherein the door can only travel to a predetermined position. The door also having at least a handle 15 so a person can easily open and close the door. As the door is opened the person can enter the enclosure and close the door behind them, in yet another illustration of this invention the enclosure entrance having a ramp 16 that one can walk up to enter the enclosure 1. The ramp 16 and enclosure floor 10 can be up of an anti-skid surface 17 to assure that no one slips walking into or while in the enclosure 1. Once in the enclosure a person now having an environment quieter than the ambient can make or receive a cell phone call in relative quiet. In one embodiment the door having a transparent window 18 mounted on the door adapted so when the door is in the closed position someone on the exterior of the enclosure can see into the interior of the enclosure. In yet another embodiment the door is fabricated from a transparent material. In one illustration the door assembly includes a series of rollers 19 to guide the door as it is opened and closed. In yet an other embodiment the door closing on a gasket 20 such that when the door is closed the gasket sealing the inner space of the enclosure from outer space wherein providing an enhanced door 11 to wall seal. The enclosure optionally having an interior light 21, illuminating the interior of the enclosure, once a person enters the enclose a switch is triggers so when the door is closed the interior of the enclosure is lit. In yet another embodiment the light within the enclosure is switched on when a person enters the enclosure, typical light on switch is a motion sensor that sense motion when a person enters the enclosure and turns on the light. Also the enclosure having ventilation means such as an interior fan 25 that brings air into the enclosure from the exterior of the enclosure. The enclosure can be fabricated in a variety of colors.

In yet another embodiment of this invention sound resistant enclosure of includes media 27 for receiving advertising indicia thereon 26. Such media for receiving advertising can include a frame to hold a poster, clips, bolts, springs or any means available so advertising indicia can be display on the enclosure. The enclosure can also have advertising affixed to or part of the enclosure displaying the advertising on any part of the enclosure.

What is claimed is:

1. A cylindrical sound resistant enclosure comprising;

an outer substantially cylindrical wall fixedly attached to at least a first top attachment support ring and at least a bottom attachment support ring, the outer cylindrical wall having an opening therein, an inner substantially cylindrical wall fixedly attached to the first top attachment support ring and fixedly attached to at least the bottom attachment support ring, the inner cylindrical wall being substantially coaxial to the outer cylindrical wall, the inner cylindrical wall having an opening therein wherein the radial position of the inner cylindrical wall opening is substantially aligned with the outer cylindrical wall opening, the inner cylindrical wall being a smaller diameter than the outer cylindrical wall, the inner cylindrical wall substantially co-axial to the outer cylindrical wall wherein creating a space between the outer and inner cylindrical wall, a sound resistant material occupying the space between the inner cylindrical wall and the outer cylindrical wall, a perforated substantially cylindrical sound shield fixedly attached to the inner wall, the sound shield having a smaller diameter that the inner wall, the sound shield substantially co-axial to the inner cylindrical wall wherein creating a space between the sound shield and inner cylindrical wall, sound resistant material occupying the space between the inner cylindrical wall and the sound shield, a top member fixedly attached to the top attachment support ring, a perforated substantially disc shaped sound shield fixedly attached to the top member within the booth creating a space between the disc shaped sound shield and the top member, sound resistant material occupying the space between the disc shaped sound shield and the top member, a floor member fixedly attached to the bottom attachment support ring, and;

a door member being a section of a substantially cylindrical member co-axial to the inner and outer walls, the door having a smaller diameter than the outer wall and a larger diameter than the inner wall, a second top attachment support ring rotateably affixed to the first attachment top support ring, a bearing mounted between the first and second top support rings allowing for the second support ring to rotate, the door fixedly attached to the second top support ring, the door adapted to rotate co-axial to the inner and outer cylindrical members such that the door slides between them, the door pivots about its radial centerline, the door is adapted to obstruct the opening in the inner and outer cylindrical walls when closed, the door is adapted to rotate between the inner and outer cylindrical wall such that to expose the openings in the inner and outer cylindrical walls when open, a door stop wherein the door can only travel to a predetermined position.

2. The cylindrical sound resistant enclosure of claim 1 further comprising;

the door member being constructed of a transparent material.

3. The cylindrical sound resistant enclosure of claim 1 further comprising;

the door member having at least one door handle.

4. The cylindrical sound resistant enclosure of claim 1 further comprising;

a plurality of rollers adapted to guide the door member.

5. The cylindrical sound resistant enclosure of claim 1 further comprising;

a gasket such that when the door is closed the gasket sealing an inner space of the enclosure from an outer space.

6. The cylindrical sound resistant enclosure of claim 1 further comprising;

a light fixedly attached to the top of the enclosure adapted to illuminate the interior of the enclosure.

7. The cylindrical sound resistant enclosure of claim 1 further comprising;

an exhaust fan fixedly attached to the enclosure adapted to take air from the exterior of the enclosure and move the air into the interior of the enclosure.

8. The cylindrical sound resistant enclosure of claim 1 further comprising;

a ramp adapted to be placed on the exterior of the enclosure.

9. The cylindrical sound resistant enclosure of claim 1 further comprising;

an anti skid surface.

10. The cylindrical sound resistant enclosure of claim 1 further comprising;

sound resistant material that is placed at the top of the enclosure.

11. The cylindrical sound resistant enclosure of claim 1 further comprising;

sound resistant material that is placed at the bottom of the enclosure.

12. The cylindrical sound resistant enclosure of claim 1 further comprising;

a media for receiving advertising indicia thereon.

13. The cylindrical sound resistant enclosure of claim 1 further comprising;

advertising indicia affixed thereon.

14. The cylindrical sound resistant enclosure of claim 1 further comprising;

the enclosure being constructed from a variety of colors.

* * * * *